US010811184B2

(12) United States Patent
Yamamoto et al.

(10) Patent No.: US 10,811,184 B2
(45) Date of Patent: Oct. 20, 2020

(54) REACTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shinichiro Yamamoto, Mie (JP); Seiji Shitama, Mie (JP)

(73) Assignees: AutoNetworks Technologies, Ltd., Yokkaichi, Mie (JP); Sumitomo Wiring Systems, Ltd., Yokkaichi, Mie (JP); Sumitomo Electric Industries, Ltd., Osaka-Shi, Osaka (JP)

( * ) Notice: Subject to any disclaimer, the term of this patent is extended or adjusted under 35 U.S.C. 154(b) by 194 days.

(21) Appl. No.: 15/972,948

(22) Filed: May 7, 2018

(65) Prior Publication Data

US 2018/0358172 A1 Dec. 13, 2018

(30) Foreign Application Priority Data

Jun. 8, 2017 (JP) ..... 2017-113830

(51) Int. Cl.
*H01F 17/04* (2006.01)
*H01F 27/32* (2006.01)
(Continued)

(52) U.S. Cl.
CPC ..... *H01F 27/324* (2013.01); *H01F 27/24* (2013.01); *H01F 27/266* (2013.01); *H01F 27/28* (2013.01);
(Continued)

(58) Field of Classification Search
CPC .... H01F 27/022; H01F 27/266; H01F 41/005; H01F 37/00; H01F 27/324
(Continued)

(56) References Cited

U.S. PATENT DOCUMENTS 8,330,822 B2 * 12/2012 McEldowney ..... A63F 13/213 315/309
8,659,381 B2 * 2/2014 Yoshikawa ..... H01F 27/30 336/180
8,717,133 B2 * 5/2014 Ooishi ..... H01F 37/00 336/55
(Continued)

FOREIGN PATENT DOCUMENTS

JP 2017-028142 A 2/2017

*Primary Examiner* — Elvin G Enad
*Assistant Examiner* — Joselito Baisa
(74) *Attorney, Agent, or Firm* — Honigman LLP

(57) ABSTRACT

Provided is a reactor having a coil including a winding portion; a magnetic core including an inner core portion and an outer core portion; an inner resin portion with which a space between the winding portion and the inner core portion is filled; and an end surface interposed member is interposed between an end surface of the winding portion and the outer core portion and includes a through hole into which the inner core portion is inserted and a resin filling hole communicating with an interior of the winding portion between the winding portion and the outer core portion. The outer core portion includes at least one recessed portion on the circumferential edge portion of the inner end surface opposing the end surface of the inner core portion, and the recessed portion is recessed inward with respect to the end surface of the inner core portion.

3 Claims, 9 Drawing Sheets

(51) Int. Cl.

| | |
|---|---|
| ***H01F 27/28*** | (2006.01) |
| ***H01F 27/24*** | (2006.01) |
| ***H01F 37/00*** | (2006.01) |
| ***H01F 27/26*** | (2006.01) |
| *H01F 3/14* | (2006.01) |

(52) U.S. Cl.
CPC ..... *H01F 27/327* (2013.01); *H01F 37/00* (2013.01); *H01F 3/14* (2013.01); *H01F 27/325* (2013.01)

(58) Field of Classification Search
USPC ..... 336/221
See application file for complete search history.

(56) References Cited

U.S. PATENT DOCUMENTS

| | | | | |
|---|---|---|---|---|
| 9,508,482 | B2 * | 11/2016 | Suzuki | H01F 27/00 |
| 9,543,817 | B2 * | 1/2017 | Deak, Sr. | H02K 1/02 |
| 9,842,683 | B1 * | 12/2017 | LeBlanc | H01F 27/325 |
| 2010/0308950 | A1 * | 12/2010 | Hsieh | H01F 27/022 336/221 |
| 2012/0092120 | A1 * | 4/2012 | Yoshikawa | H01F 27/022 336/220 |
| 2012/0206232 | A1 * | 8/2012 | Yamamoto | H01F 37/00 336/210 |
| 2012/0299685 | A1 * | 11/2012 | Yokota | H01F 37/00 336/212 |
| 2015/0043262 | A1 * | 2/2015 | Ito | H01F 37/00 363/131 |
| 2015/0130576 | A1 * | 5/2015 | Suzuki | H01F 27/00 336/92 |

* cited by examiner

REACTOR

CROSS-REFERENCE TO RELATED APPLICATIONS

This application claims priority of Japanese Patent Application No. JP 2017-113830 filed Jun. 8, 2017.

TECHNICAL FIELD

The present disclosure relates to a reactor.

BACKGROUND

A reactor is a component of a circuit that performs a voltage step-up operation and a voltage step-down operation. For example, JP 2017-28142A discloses a reactor that includes a coil including a winding portion, a ring-shaped magnetic core that is arranged inside and outside of the coil (winding portion) and forms a closed magnetic circuit, and an insulating interposed member that is interposed between the coil (winding portion) and the magnetic core. The above-described magnetic core includes an inner core portion that is arranged inside of the winding portion and an outer core portion that is arranged outside of the winding portion. The insulating interposed member includes an inner interposed member that is interposed between the inner circumferential surface of the winding portion and the inner core portion, and an end surface interposed member that is interposed between the end surface of the winding portion and the outer core portion.

The reactor disclosed in JP 2017-28142A includes an inner resin portion with which the space between the inner circumferential surface of the winding portion of the coil and the inner core portion is filled. In the reactor disclosed in JP 2017-28142A, the inner resin portion is formed by resin filling a space between the inner circumferential surface of the winding portion and the outer circumferential surface of the inner core portion from an end surface side of the winding portion via a resin filling hole formed in the end surface interposed member from the outer core portion side.

SUMMARY

In the above-described reactor including the inner resin portion, when the inner resin portion is formed by resin filling the winding portion through the resin filling hole formed between the end surface interposed member and the outer core portion, the resin filling hole is narrow, and it is difficult for the resin to flow into the winding portion. For this reason, the resin is not likely to sufficiently fill the space between inner circumferential surface of the winding portion and the inner core portion, and there is a higher likelihood that a void will be formed in the inner resin portion. Accordingly, it is desired that the ability of the resin to fill the winding portion is improved.

An aim of the present disclosure is to provide a reactor that can improve the ability of resin to fill a winding portion when the inner resin portion is formed by resin filling the space between the inner circumferential surface of the winding portion of the coil and the inner core portion of the magnetic core.

A reactor according to the present disclosure includes a coil including a winding portion; a magnetic core including an inner core portion arranged inside of the winding portion and an outer core portion arranged outside of the winding portion; an inner resin portion with which a space between an inner circumferential surface of the winding portion and the inner core portion is filled; and an end surface interposed member that is interposed between an end surface of the winding portion and the outer core portion and includes a through hole into which the inner core portion is inserted and a resin filling hole that communicates with an interior of the winding portion between the winding portion and the outer core portion. The outer core portion includes at least one recessed portion on a circumferential edge portion of an inner end surface that opposes an end surface of the inner core portion, and the recessed portion is formed so as to be recessed inward with respect to the end surface of the inner core portion.

The above-described reactor can improve the ability of resin to fill the winding portion when the inner resin portion is formed by resin filling the space between the inner circumferential surface of the winding portion of the coil and the inner core portion of the magnetic core.

DETAILED DESCRIPTION OF PREFERRED EMBODIMENTS

Figure 1:
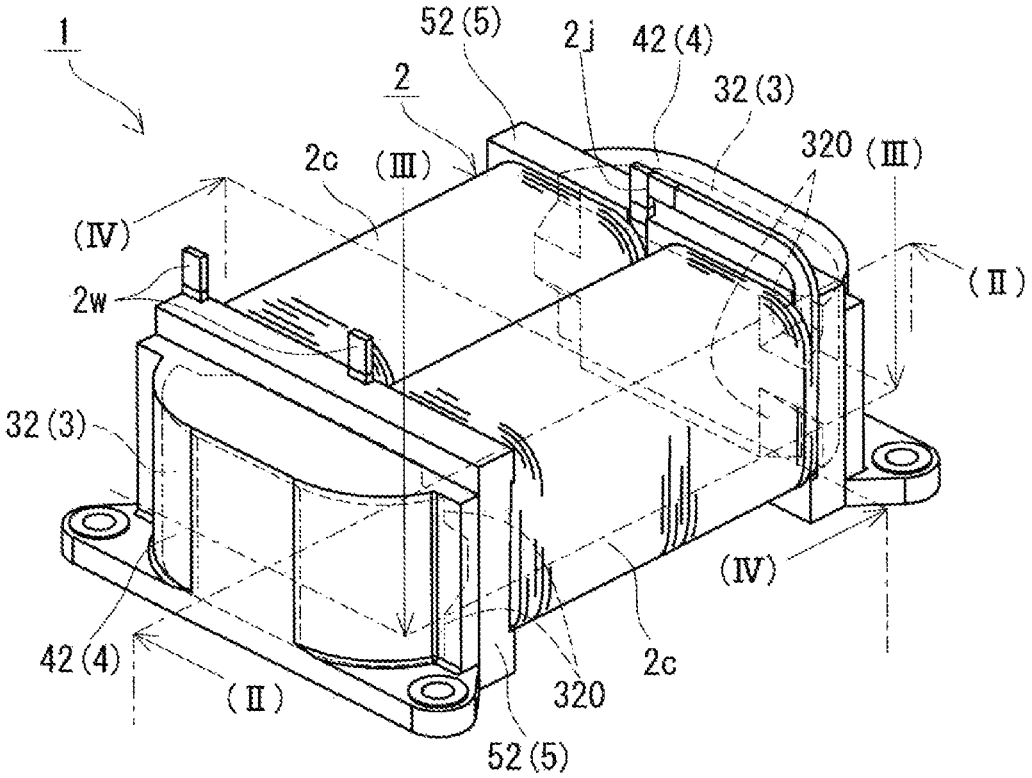
FIG. 1 is a schematic perspective view of a reactor according to Embodiment 1.

First, embodiments of the present disclosure will be listed and described.

The reactor according to an aspect of the present disclosure includes: a coil including a winding portion; a magnetic core including an inner core portion arranged inside of the winding portion and an outer core portion arranged outside of the winding portion; an inner resin portion with which a space between an inner circumferential surface of the winding portion and the inner core portion is filled; and an end surface interposed member that is interposed between an end surface of the winding portion and the outer core portion and includes a through hole into which the inner core portion is inserted and a resin filling hole that communicates with an interior of the winding portion between the winding portion and the outer core portion. The outer core portion includes at least one recessed portion on a circumferential edge portion of an inner end surface that opposes an end surface of the inner core portion, and the recessed portion is formed so as to be recessed inward with respect to the end surface of the inner core portion.

According to the above-described reactor, due to including the recessed portion at the circumferential edge portion on the inner end surface of the outer core portion, an interval is formed between the end surface interposed member and the outer core portion and it is easier to introduce the resin into the resin filling hole due to the recessed portion, and therefore it is easier for the resin to flow into the winding portion through the resin filling hole. For this reason, the resin is likely to sufficiently fill the space between the inner circumferential surface of the winding portion and the inner core portion. Accordingly, the reactor can improve the ability of resin to fill the winding portion when the inner resin portion is formed by the resin filling the space between the inner circumferential surface of the winding portion and the inner core portion, and therefore a void is not likely to be formed in the inner resin portion.

As one aspect of the above-described reactor, the recessed portion is provided at a corner portion of the inner end surface.

In the magnetic core, the location of the corner portion of the inner end surface of the outer core portion has a relatively small influence on the active magnetic circuit since it is relatively difficult for a magnetic flux to flow and such a location is not likely to function as an active magnetic circuit. For this reason, the recessed portion is provided at the corner portion of the inner end surface of the outer core portion, whereby the filling ability of the resin can be improved and a decrease in the area of the effective magnetic circuit can be suppressed.

As one aspect of the above-described reactor, the depth of the recessed portion is 2 mm or more.

Due to the depth of the recessed portion (recess amount) being 2 mm or more, the interval between the end surface interposed member and the outer core portion, which is formed by the recessed portion, can be sufficiently ensured, and it is easier to introduce resin into the resin filling hole, and therefore it is possible to improve the ability of the resin to fill the winding portion from the resin filling hole. The "depth of the recessed portion" in this context refers to the distance from the inner end surface of the outer core portion in the axial direction of the winding portion to the bottom surface of the recessed portion. If the depth of the recessed portion is excessively large, the volume of the outer core portion accordingly decreases in size and magnetic saturation is more likely to occur, and therefore the depth of the recessed portion is preferably 10 mm or less and more preferably 5 mm or less, for example.

A specific example of a reactor according to an embodiment of the present disclosure will be described hereinafter with reference to the drawings. Items with the same name are denoted by the same reference numerals in the drawings. Note that the present disclosure is not limited to these examples and is indicated by the claims, and meanings equivalent to the claims and all changes within the scope are intended to be encompassed therein.

Embodiment 1

Configuration of Reactor

Figure 2:
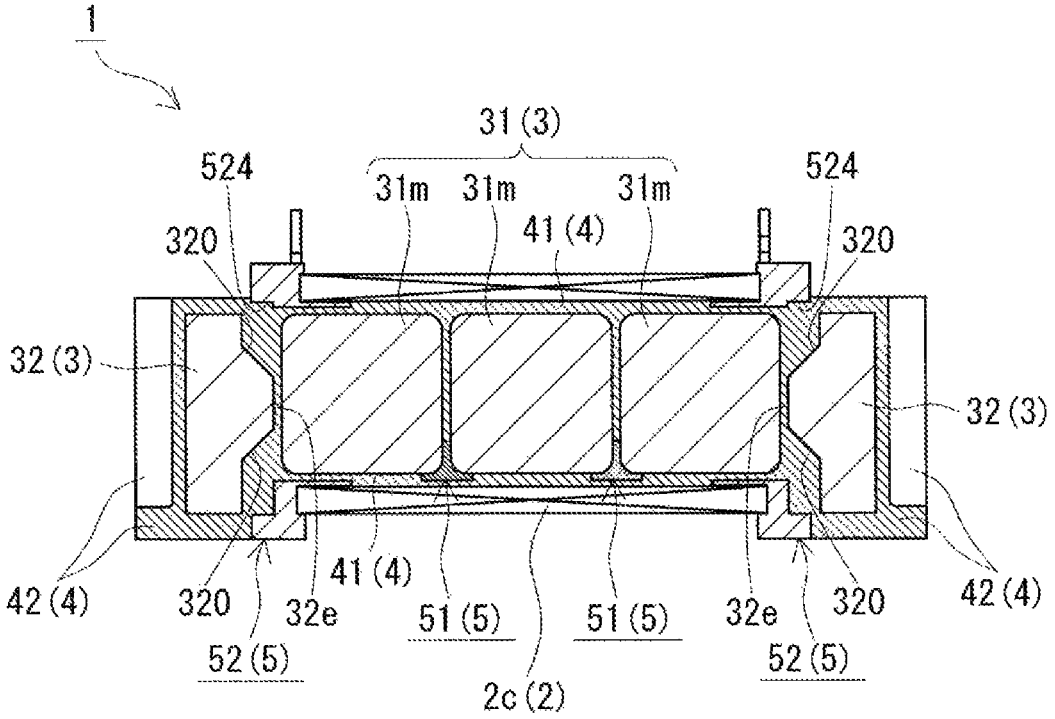
FIG. 2 is a schematic vertical cross-sectional view obtained by cutting along line (II)-(II) shown in FIG. 1.
Figure 3:
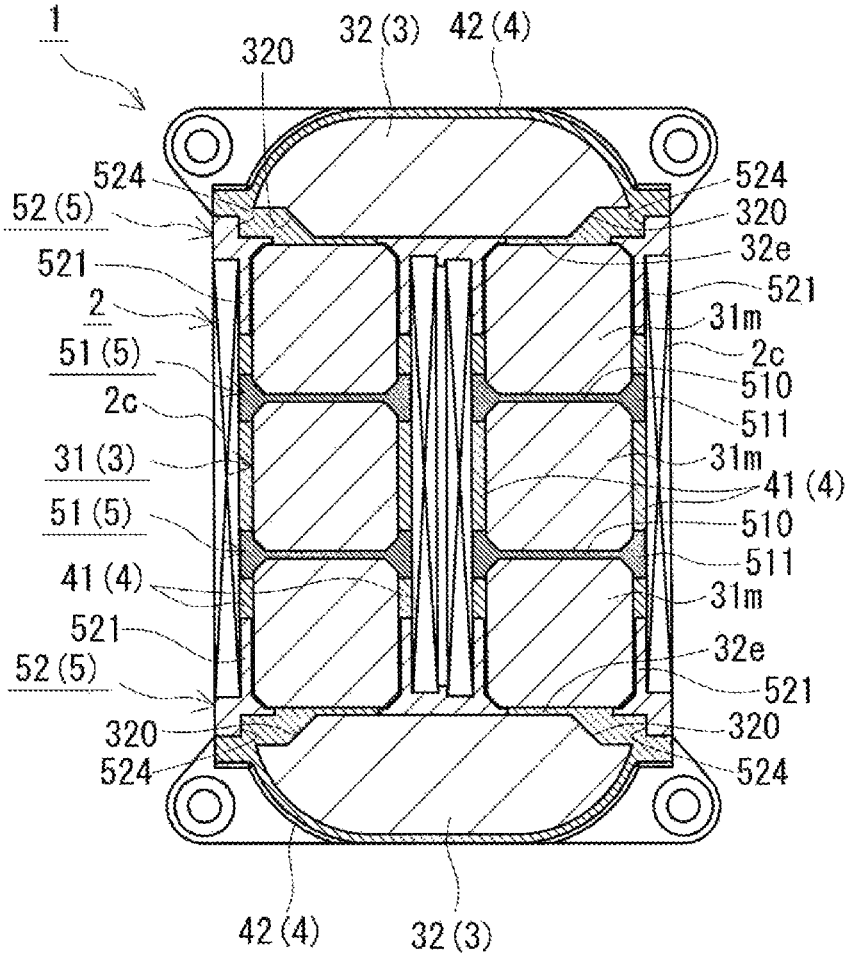
FIG. 3 is a schematic plane cross-sectional view obtained by cutting along line (III)-(III) shown in FIG. 1.
Figure 4:
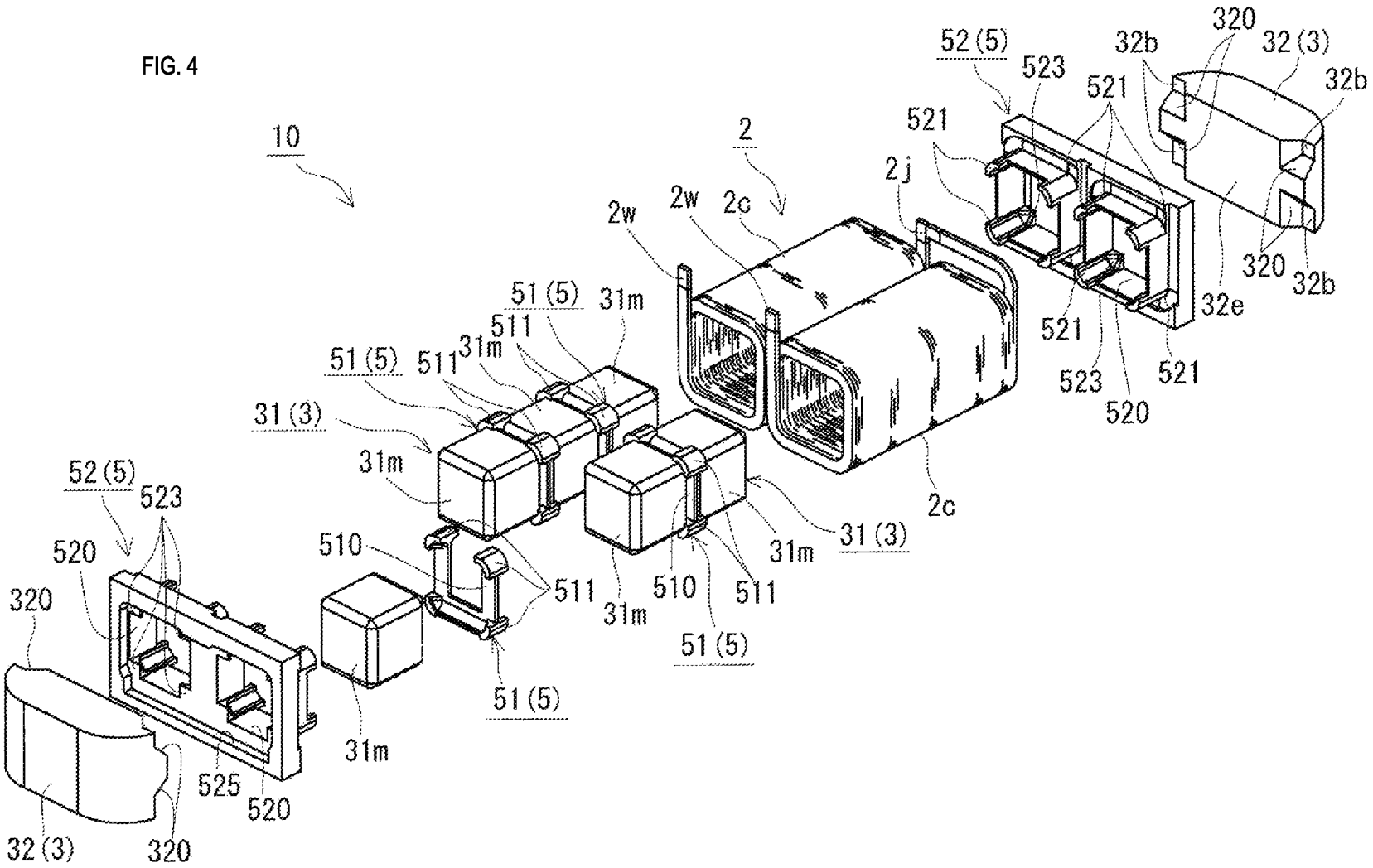
FIG. 4 is a schematic exploded perspective view of a combined body included in the reactor according to Embodiment 1.

A reactor 1 according to Embodiment 1 will be described with reference to FIGS. 1 to 9. As shown in FIGS. 1 to 4, the reactor 1 of Embodiment 1 includes a combined body 10 (see FIG. 4) that includes a coil 2 having winding portions 2*c*, a magnetic core 3 that is arranged inside and outside of the winding portions 2*c* and constitutes a closed magnetic circuit, and insulating interposed members 5 interposed between the coil 2 and the magnetic core 3. The coil 2 includes two winding portions 2*c*, and the two winding portions 2*c* are arranged in horizontal alignment with each other. As shown in FIGS. 2 and 3, the magnetic core 3 includes two inner core portions 31 that are arranged inside of the winding portions 2*c* and two outer core portions 32 that are arranged outside of the winding portions 2*c* and connect the end portions of the two inner core portions 31 (see FIG. 4 as well). As shown in FIG. 4, the insulating interposed members 5 include inner interposed members 51 that are interposed between the inner circumferential surfaces of the winding portions 2*c* and the inner core portions 31, and end surface interposed members 52 that are interposed between the end surfaces of the winding portions 2*c* and the outer core portions 32 (see FIGS. 6 and 7 as well). Also, as shown in FIGS. 2 and 3, the reactor 1 includes a molded resin portion 4 that integrally covers the magnetic core 3 (inner core portions 31 and outer core portions 32). The molded resin portion 4 includes inner resin portions 41 with which the spaces between the inner circumferential surfaces of the winding portions 2*c* and the inner core portions 31 are filled, and outer resin portions 42 that cover at least part of the outer core portions 32. As shown in FIGS. 2 to 4, one feature of the reactor 1 is that it includes at least one recessed portion 320 on the circumferential edge portions of the inner end surfaces 32*e* opposing the end surfaces of the inner core portions 31 (see FIGS. 5 to 7 as well).

Figure 6:
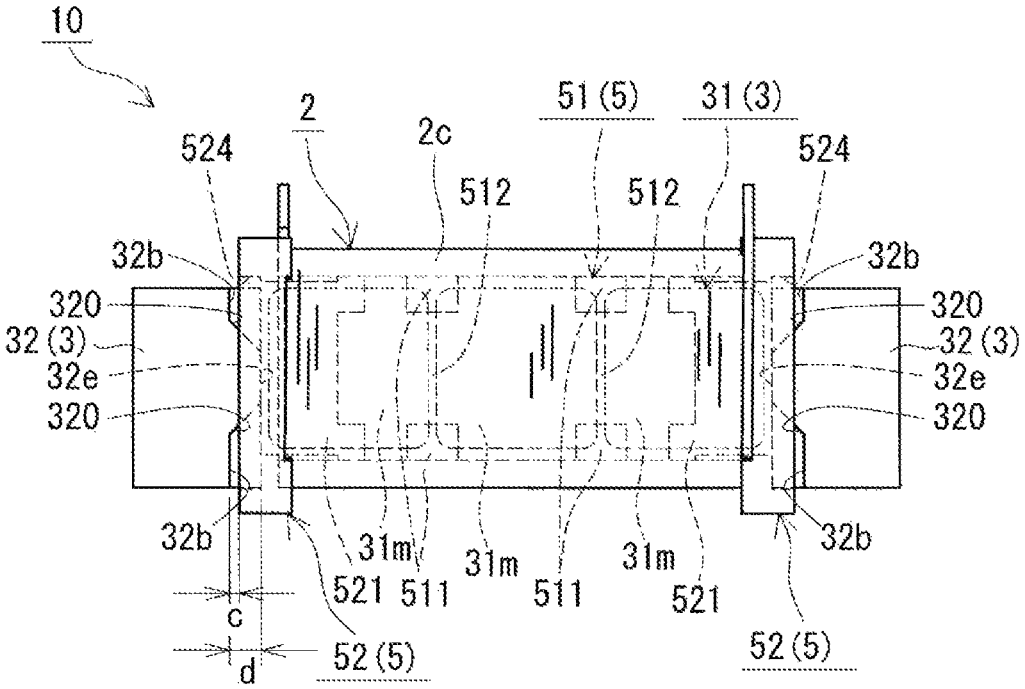
FIG. 6 is a schematic side view of a combined body included in the reactor according to Embodiment 1.
Figure 8:
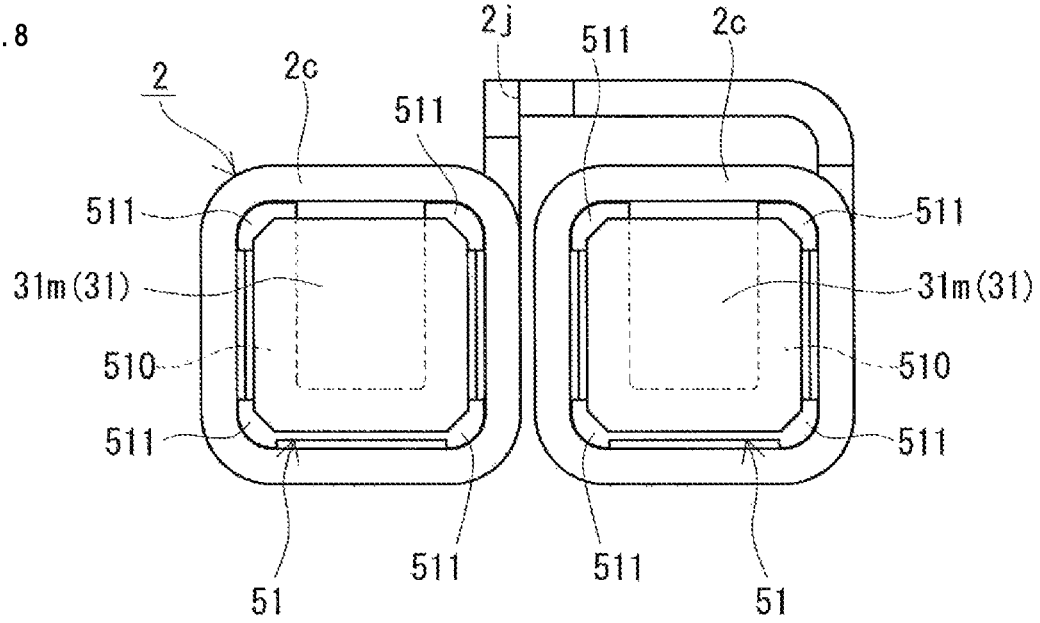
FIG. 8 is a schematic view of a set of a coil and inner core portions included in the reactor according to Embodiment 1, viewed from an end portion side of a winding portion.
Figure 9:
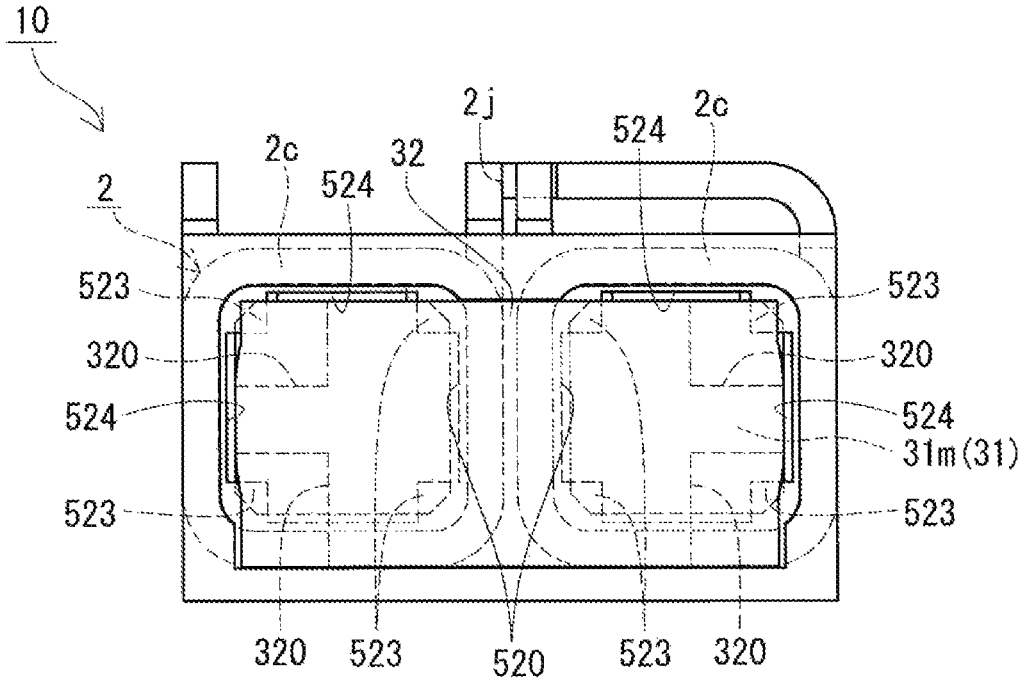
FIG. 9 is a schematic front view of a combined body included in the reactor according to Embodiment 1.

The reactor 1 is installed in an installation target (not shown) such as a converter case, for example. Here, in the reactor 1 (coil 2 and magnetic core 3), the lower portions of FIGS. 1 and 4 denote the installation side that faces the installation target, the installation side is set as "down", the side opposite thereto is set as "up", and the vertical direction is set as the vertical direction (height direction). Also, the alignment direction (the left-right direction of FIG. 3) of the winding portions 2*c* of the coil 2 is set as the horizontal direction (width direction), and the direction along the axial direction (left-right direction in FIG. 2 and vertical direction in FIG. 3) of the coil 2 (winding portions 2*c*) is set as the length direction. FIGS. 2 and 6 are vertical cross-sectional views obtained by cutting in the vertical direction along the axial direction of the winding portion 2*c*, and FIG. 3 is a plane cross-sectional view obtained by cutting with a plane that divides the winding portion 2*c* into top and bottom. FIG. 8 is a view of a set of the coil 2 and the inner core portion 31 from the end surface side of the winding portions 2*c*, and FIG. 9 is a front view of the combined body 10 viewed in the axial direction of the winding portions 2*c* from the outer core portion 32 side. Hereinafter, configurations of the reactor 1 will be described in detail.

Coil

As shown in FIGS. 1 and 4, the coil 2 includes two winding portions 2*c* that are formed by respectively winding two winding wires 2*w* in the form of spirals, and end portions on one side of the winding wires 2*w* that form the two winding portions 2*c* are connected to each other via a bonding portion 2*j*. The two winding portions 2*c* are arranged in horizontal alignment (in parallel) such that the axial directions thereof are parallel. The bonding portion 2*j* is formed by bonding the end portions on the one side of the winding wires 2*w* pulled out from the winding portions 2*c*, using a bonding method such as welding, soldering, or brazing. The end portions on the other side of the winding wires 2*w* are pulled out in an appropriate direction (in this example, upward) from the winding portions 2*c*. Terminal fittings (not shown) are attached as appropriate to the other end portions of the winding wires 2*w* (i.e., the two ends of the coil 2) and are electrically connected to an external apparatus (not shown) such as a power source. A known coil can be used as the coil 2, and for example, the two winding portions 2*c* may be formed with one continuous winding wire.

Winding Portions

The two winding portions 2*c* are composed of winding wires 2*w* with the same specification and have the same shape, size, winding direction, and turn count, and the adjacent turns that form the winding portions 2*c* are adhered to each other. For example, the winding wires 2*w* are coated wires (so-called enamel wires) that have conductors (copper, etc.) and insulating coverings (polyamide-imide, etc.) on the outer circumferences of the conductors. In this example, the winding portions 2*c* are quadrangular cylinder-shaped (specifically, rectangular cylinder-shaped) edgewise coils obtained by winding the winding wires 2*w*, which are coated flat wires, in an edgewise manner, and the end surface shapes of the winding portions 2*c* viewed from the axial direction are rectangular shapes with rounded corner portions (see FIG. 8 as well). The shapes of the winding portions 2*c* are not particularly limited, and for example, may be cylinder-shaped, elliptical cylinder-shaped, ovoid cylinder-shaped (racetrack-shaped), or the like. The specifications of the winding wires 2*w* and the winding portions 2*c* can be changed as appropriate.

In this example, as shown in FIG. 1, when the reactor 1 is constituted without the coil 2 (winding portions 2*c*) being covered by the molded resin portion 4, the outer circumferential surface of the coil 2 is in an exposed state (see FIGS. 2 and 3 as well). For this reason, heat is easily dissipated from the coil 2 to the exterior, and the heat dissipation property of the coil 2 can be improved.

In addition, the coil 2 may be a molded coil molded using resin having an electrical insulating property. In this case, the coil 2 can be protected from the external environment (dust, corrosion, and the like) and the mechanical strength and electrical insulating property of the coil 2 can be increased. For example, due to the inner circumferential surfaces of the winding portions 2*c* being covered with resin, electrical insulation between the winding portions 2*c* and the inner core portions 31 can be increased. As the resin for molding the coil 2, for example, it is possible to use a thermosetting resin such as epoxy resin, unsaturated polyester resin, urethane resin, or silicone resin, or a thermoplastic resin such as polyphenylene sulfide (PPS) resin, polytetrafluoroethylene (PTFE) resin, liquid crystal polymer (LCP), polyamide (PA) resin such as nylon 6 and nylon 66, polyimide (PI) resin, polybutylene terephthalate (PBT) resin, and acrylonitrile butadiene styrene (ABS) resin.

Alternatively, the coil 2 may be a heat seal coil that includes heat seal layers between adjacent turns that form the winding portions 2*c*, and that is formed by heat sealing adjacent turns together. In this case, the adjacent turns can be further adhered together.

Magnetic Core 3

As shown in FIGS. 2 to 4, the magnetic core 3 includes two inner core portions 31 arranged inside of the winding portions 2*c* and two outer core portions 32 arranged outside of the winding portions 2*c*. The inner core portions 31 are portions that are located inside of the winding portions 2*c* arranged in horizontal alignment, and at which the coil 2 is arranged. In other words, the two inner core portions 31 are arranged in horizontal alignment (in parallel), similarly to the winding portions 2*c*. Parts of the end portions in the axial direction of the inner core portions 31 may protrude from the winding portions 2*c*. The outer core portions 32 are portions that are located outside of the winding portions 2*c*, and on which the coil 2 is substantially not arranged (i.e., portions that protrude (are exposed) from the winding portions 2*c*). The outer core portions 32 are provided so as to connect the end portions of the two inner core portions 31. In this example, the outer core portions 32 are respectively arranged so as to sandwich the inner core portions 31 from the two ends, and the end surfaces of the two inner core portions 31 oppose and are connected to respective inner end surfaces 32*e* of the outer core portions 32, whereby a ring-shaped magnetic core 3 is constituted. When induction occurs due to a current being applied to the coil 2, a magnetic flux flows in the magnetic core 3, whereby a closed magnetic circuit is formed.

Inner Core Portions

The shapes of the inner core portions 31 are shapes that correspond to the inner circumferential surfaces of the winding portions 2*c*. In this example, the inner core portions 31 are formed in quadrangular prism shapes (rectangular prism shapes), and the end surface shapes of the inner core portions 31 viewed from the axial direction are rectangular shapes with chamfered corner portions (see FIG. 8 as well). As shown in FIG. 8, the outer circumferential surfaces of the inner core portions 31 each have four flat surfaces (an upper surface, a lower surface, and two side surfaces) and four corner portions. Here, the sides of the two winding portions 2*c* that face each other are denoted as inner sides, and the opposite sides are denoted as outer sides, and among the two side surfaces, the side surfaces on the inner sides of the two winding portions 2*c* that oppose each other are denoted as inner side surfaces, and the side surfaces on the outer sides, which are located on the sides opposite to the inner sides, are denoted as outer side surfaces. Also, in this example, as shown in FIGS. 2 to 4, the inner core portions 31 each include multiple inner core pieces 31*m* and the inner core pieces 31*m* are configured to be coupled in the length direction.

The inner core portions 31 (inner core pieces 31*m*) are formed with a material that contains a soft magnetic material. For example, the inner core pieces 31*m* are formed with pressed powder molded bodies obtained by press-molding a soft magnetic powder such as iron or an iron alloy (Fe—Si alloy, Fe—Si—Al alloy, Fe—Ni alloy, or the like), a coating soft magnetic powder further including an insulating coating, and the like, molded bodies made of a composite material containing a soft magnetic powder and a resin, or the like. As the resin for the composite material, it is possible to use a thermosetting resin, a thermoplastic resin, a normal-temperature curable resin, a low-temperature curable resin, or the like. Examples of thermosetting resins include unsaturated polyester resin, epoxy resin, urethane resin, and silicone resin. Examples of thermoplastic resins include PPS resin, PTFE resin, LCP, PA resin, PI resin, PBT resin, and ABS resin. In addition, it is also possible to use a BMC (bulk molding compound) obtained by mixing calcium carbonate and glass fiber into unsaturated polyester, millable silicone rubber, millable urethane rubber, or the like. In this example, the inner core pieces 31*m* are formed with pressed powder molded bodies.

Outer Core Portions

The outer core portions 32 are each constituted by one core piece. Similarly to the inner core pieces 31*m*, the outer core portions 32 are formed with a material containing a soft magnetic material, and it is possible to use the above-described pressed powder molded bodies, composite materials, or the like thereas. In this example, the outer core portions 32 are formed with pressed powder molded bodies.

The shape of the outer core portions 32 is not particularly limited, as long as the inner end surfaces 32*e* that respectively oppose the end surfaces of the two inner core portions 31 are included and a closed magnetic circuit is formed by being combined with the inner core portion 31. In this example, as shown in FIG. 2, when the magnetic core 3 is constituted, the outer core portions 32 protrude downward with respect to the inner core portions 31 and the lower surfaces of the outer core portions 32 are level with the lower surface of the coil 2 (winding portions 2*c*). The upper surfaces of the outer core portions 32 are level with the upper surfaces of the inner core portions 31.

Recessed Portions

Figure 5:
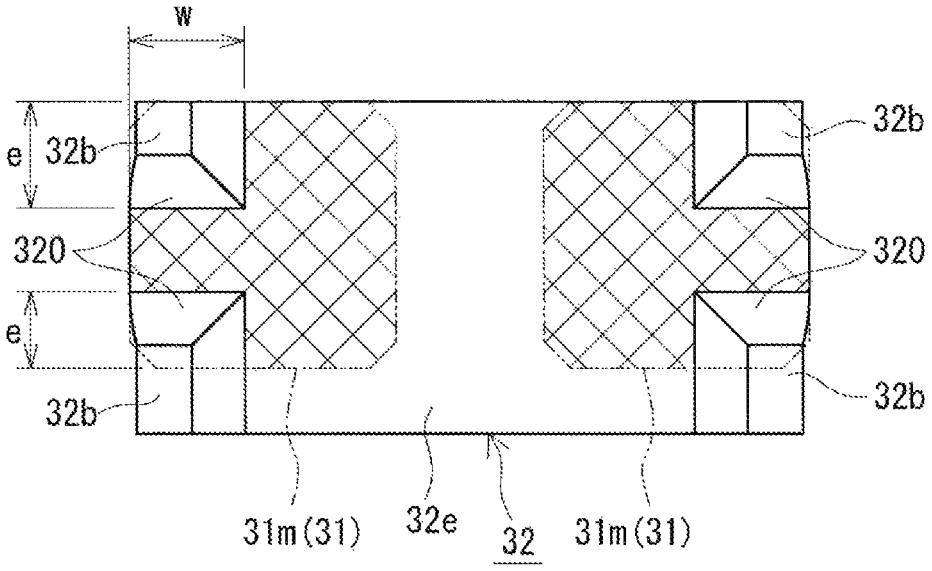
FIG. 5 is a schematic view of an outer core portion included in the reactor according to Embodiment 1, viewed from an inner end surface side.
Figure 7:
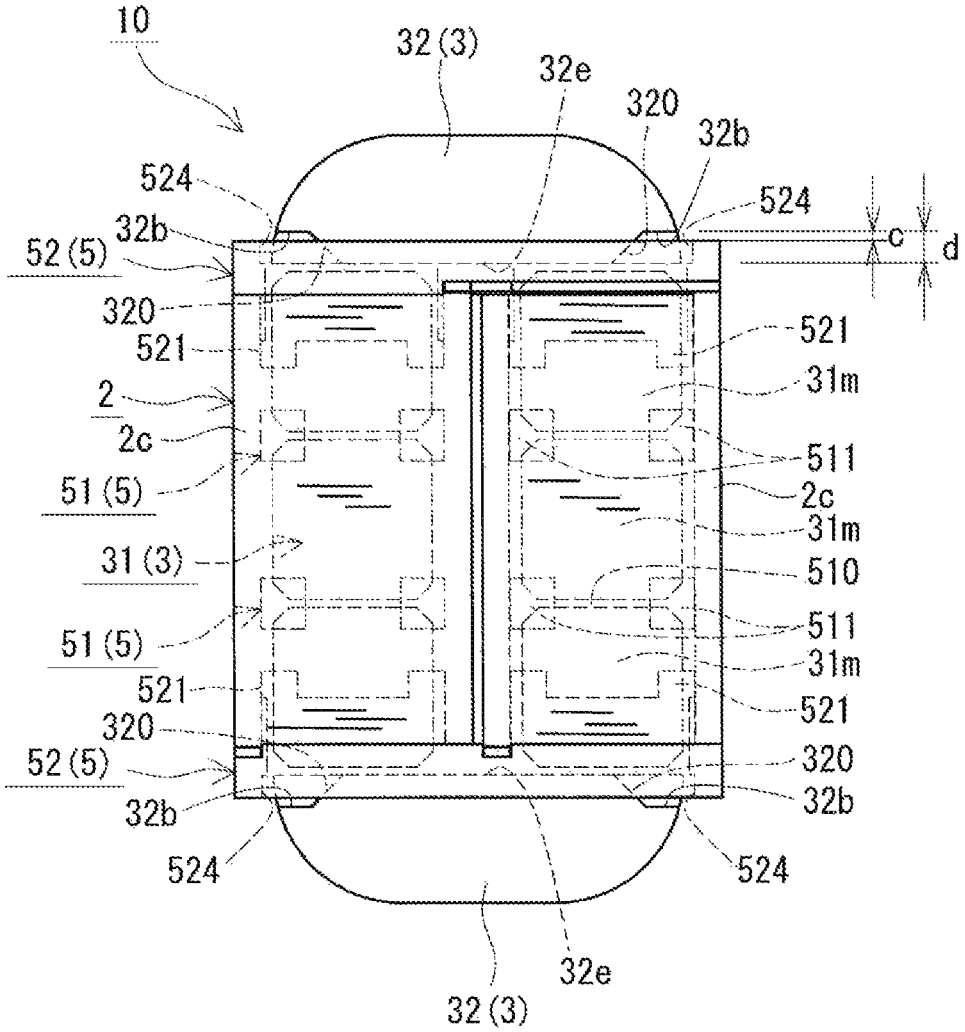
FIG. 7 is a schematic top view of a combined body included in the reactor according to Embodiment 1.

The outer core portion 32 includes at least one recessed portion 320 on the circumferential edge portion of the inner end surface 32*e*. In this example, the recessed portions 320 are formed by cutting off the four corners on the inner circumferential surface 32*e* side of the outer core portion 32, and as shown in FIG. 5, the recessed portions 320 are respectively provided at the corner portions of the inner end surface 32*e*. Also, in the state of the combined body 10, the recessed portions 320 are formed so as to be recessed inward with respect to the end surfaces of the inner core portions 31, or more specifically, with respect to the circumferential edges (outer circumferential surfaces of the inner core portions) of the end surfaces of the inner core portions 31 when the outer core portions 32 are viewed through in the axial direction of the winding portions 2*c* (see FIGS. 6 and 7 as well). The recessed portions 320 shown in this example have a rectangular outline shape in a view from the inner end surface 32*e* side, and as shown in FIGS. 6 and 7, the inner circumferential surfaces are inclined so as to widen from the bottom surface 32*b* to the inner end surface 32*e*. The outline shape of the recessed portions 320 is not particularly limited, and for example, it may be triangular, trapezoidal, fan-shaped, or the like.

As shown in FIGS. 6 and 7, when the combined body 10 is constituted, the recessed portions 320 formed in the outer core portions 32 form intervals c between the end surface interposed members 52 and the outer core portions 32, and are for making it easier to introduce the resin into the later-described resin filling holes 524. The depth d of the recessed portions 320 is not particularly limited as long as the intervals c are formed between the end surface interposed members 52 and the outer core portions 32 at the locations of the recessed portions 320, but for example, it is 2 mm or more. Accordingly, it is easier to sufficiently ensure the intervals c between the end surface interposed members 52 and the outer core portions 32 formed by the recessed portions 320, and it is easier to introduce the resin into the resin filling holes 524. More preferably, the depth d of the recessed portions 320 is preferably set such that intervals c of at least 1 mm or more are formed between the end surface interposed members 52 and the outer core portions 32. On the other hand, if the depth d of the recessed portions 320 is too large, the volume of the outer core portions 32 accordingly becomes smaller, and magnetic saturation is more likely to occur, and therefore the depth d of the recessed portion 320 is preferably 10 mm or less, for example, and is more preferably 5 mm or less. "Depth d of the recessed portion" refers to the distance in the axial direction of the winding portions 2*c* from the inner end surface 32*e* of the outer core portion 32 to the bottom surface 32*b* of the recessed portion 320.

The size (volume) of the recessed portions 320 is set such that the magnetic circuit area is ensured to a certain extent. Specifically, the area of the recessed portions 320 is set such that the surface area of the regions (indicated by double-hatching in FIG. 5) of the inner end surfaces 32*e* excluding the recessed portions 320, which substantially oppose the end surfaces of the inner core portions 31, is 60% or more, and furthermore 70% or more of the areas of the end surfaces of the inner core portions 31. Accordingly, magnetic flux leakage that occurs at the locations of the recessed portions 320 can be suppressed.

An example of dimensions of the recessed portion 320 will be given with reference to FIG. 5. A recession amount e of the recessed portions 320 from the outer circumferential surfaces (upper surface or lower surface) of the inner core portions 31 in the height direction (see FIG. 6) that is orthogonal to the axial direction of the winding portions 2*c* is set to be 3 mm or more, for example, and is further set to be 5 mm or more. Also, a width w of the recessed portions 320 in the width direction (see FIG. 7) that is orthogonal to the axial direction of the winding portions 2*c* is set to be 3 mm or more, for example, and is further set to be 5 mm or more. If the recession amount e of the recessed portions 320 is 3 mm or more and the width w is 3 mm or more, it is easy to sufficiently ensure the flow path area of the later-described resin filling holes 524. On the other hand, from the viewpoint of ensuring the flow path area, for example, the recession amount e of the recessed portions 320 is preferably 10 mm or less, and the width w of the recessed portions is preferably 10 mm or less.

Although FIG. 5 illustrates an exemplary case in which the recessed portions 320 are provided on the corner portions of the inner end surfaces 32*e*, the locations at which the recessed portions 320 are formed are not limited to the corner portions of the inner end surfaces 32*e*, and for example, the recessed portions 320 may be provided on the sides that constitute the circumferential edges of the inner end surfaces 32*e*. In this case, it is preferable that the recessed portions 320 are provided at positions opposing the circumferential edges of the inner end surfaces 32*e* in the circumferential direction. Also, the number of recessed portions 320 need only be at least one at the positions corresponding to the end surfaces of the inner core portions 31.

The insulating interposed members 5 are members that are interposed between the coil 2 (winding portions 2*c*) and the magnetic core 3 (inner core portions 31 and outer core portions 32) and that ensure electrical insulation between the coil 2 and the magnetic core 3, and include the inner interposed members 51 and the end surface interposed members 52. The insulating interposed members 5 (inner interposed members 51 and end surface interposed members 52) are formed with resin having an electrical insulating property, such as epoxy resin, unsaturated polyester resin, urethane resin, silicone resin, PPS resin, PTFE resin, LCP, PA resin, PI resin, PBT resin, or ABS resin. In this example, the inner interposed members 51 and the end surface interposed members 52 are formed with PPS resin.

Inner Interposed Members

As shown in FIGS. 4, 6, and 7, the inner interposed members 51 are interposed between the inner circumferential surfaces of the winding portions 2*c* and the outer circumferential surfaces of the inner core portions 31, and thus electrical insulation between the winding portions 2*c* and the inner core portions 31 is ensured. Also, the inner interposed members 51 form intervals that are to serve as flow paths for resin that is to form the inner resin portions 41 (see FIGS. 2 and 3) between the inner circumferential surfaces of the winding portions 2*c* and the outer circumferential surfaces of the inner core portions 31 (see FIG. 8 as well). In this example, as shown in FIG. 4, the inner interposed members 51 include plate-shaped partitioning portions 510 that are interposed between the inner core pieces 31*m* and protruding pieces 511 that are formed on the corner portions of the partitioning portions 510 and extend in the length direction along the corner portions of both adjacent core pieces 31*m*. The partitioning portions 510 shown in this example are formed into U shapes whose upper sides are open. The partitioning portions 510 hold the intervals between the inner core pieces 31*m* and form gaps between the inner core pieces 31*m*. As shown in FIGS. 6 and 7, the protruding pieces 511 hold the corner portions of the inner core pieces 31*m*, are interposed between the inner circumferential surfaces of the winding portions 2*c* and the outer circumferential surfaces of the inner core pieces 31*m*, and position the inner core pieces 31*m* (inner core portions 31) in the winding portions 2*c*. Intervals are formed by the protruding pieces 511 between the inner circumferential surfaces of the winding portions 2*c* and the outer circumferential surfaces of the inner core portions 31, and as shown in FIG. 8, intervals are ensured at the four surfaces (upper surface, lower surface, and both side surfaces) of each inner core portion 31. Resin fills the intervals between the inner circumferential surfaces of the winding portions 2*c* and the outer circumferential surfaces of the inner core portions 31, whereby the inner resin portions 41 (see FIGS. 2 and 3) are formed.

End Surface Interposed Members

As shown in FIGS. 4, 6, and 7, the end surface interposed members 52 are interposed between the end surfaces of the winding portions 2*c* and the inner end surfaces 32*e* of the outer core portions 32 and electrical insulation between the winding portions 2*c* and the outer core portions 32 is ensured. The end surface interposed members 52 are arranged at both ends of the winding portions 2*c*, and as shown in FIG. 4, are rectangular frame-shaped bodies that each have two through holes 520 into which the inner core portions 31 are inserted. In this example, protrusions 523 that bulge inward from the through holes 520 are formed at positions that come into contact with the corner portions at the end surfaces of the inner core portions 31 (inner core pieces 31*m*). The protrusions 523 are interposed between the corner portions at the end surfaces of the inner core portions 31 and the inner end surfaces 32*e* of the outer core portions 32, whereby intervals are formed between the end surfaces of the inner core portions 31 and the inner end surfaces 32*e* of the outer core portions 32. Also, as shown in FIG. 9, when the combined body 10 is constituted, through holes 520 are formed such that the resin filling holes 524 that communicate with the interiors of the winding portions 2*c* are formed between the winding portions 2*c* and the outer core portions 32. The resin can fill the intervals (see FIG. 8) between the inner circumferential surfaces of the winding portions 2*c* and the outer circumferential surfaces of the inner core portions 31 via the resin filling holes 524.

As shown in FIG. 4, recessed fitting portions 525 into which the inner end surface 32*e* sides of the outer core portions 32 are fit are formed on the outer core portion 32 sides (front surface sides) of the end surface interposed members 52, and the outer core portions 32 are positioned with respect to the end surface interposed members 52 by the fitting portions 525. Also, protruding pieces 521 that extend in the length direction along the corner portions of the inner core pieces 31*m* located at the end portions of the inner core portions 31 are formed on the inner core portion 31 sides (rear surface sides) of the end surface interposed members 52. As shown in FIGS. 6 and 7, the protruding pieces 521 hold the corner portions of the inner core pieces 31*m* located on the end portions of the inner core portions 31, are interposed between the inner circumferential surfaces of the winding portions 2*c* and the outer circumferential surfaces of the inner core pieces 31*m*, and position the inner core pieces 31*m* (inner core portions 31) in the winding portions 2*c*. The inner core portions 31 are positioned with respect to the end surface interposed members 52 by the protruding pieces 521, and as a result, the inner core portions 31 and the outer core portions 32 are positioned via the end surface interposed members 52.

Molded Resin Portion

Also, as shown in FIGS. 2 and 3, the molded resin portion 4 integrally covers the magnetic core 3 (inner core portions 31 and outer core portions 32) and includes the inner resin portions 41 and the outer resin portions 42. The molded resin portion 4 is formed with a resin having an electrical insulation property, such as epoxy resin, unsaturated polyester resin, urethane resin, silicone resin, PPS resin, PTFE resin, LCP, PA resin, PI resin, PBT resin, and ABS resin. In this example, the inner resin portions 41 and the outer resin portions 42 are formed with PPS resin.

Inner Resin Portions

The inner resin portions 41 are formed by resin filling the intervals between the inner circumferential surfaces of the winding portions 2*c* and the outer circumferential surfaces of the inner core portions 31, and are in close contact with the inner circumferential surfaces of the winding portions 2*c* and the outer circumferential surfaces of the inner core portions 31. Also, in this example, as shown in FIG. 2, the resin that forms the inner resin portions 41 also fills the spaces between the inner core pieces 31*m* formed by the partitioning portions 510 of the inner interposed members 51.

Outer Resin Portions

The outer resin portions 42 are formed so as to cover at least part of the outer core portions 32. In this example, when the combined body 10 is formed, the outer resin portions 42 are formed so as to cover the entireties of the outer core portions 32 that are exposed to the outside. Specifically, the outer circumferential surfaces, upper surfaces, and lower surfaces of the outer core portions 32, excluding the inner end surfaces 32*e* of the outer core portions 32 in contact with the end surface interposed members 52, are covered by the outer resin portions 42, and the surfaces of the outer core portions 32 are not exposed to the exterior.

The molded resin portion 4 is formed through injection molding, for example. In the present embodiment, the outer resin portions 42 and the inner resin portions 41 are formed integrally through the resin filling holes 524 (see FIG. 9) formed in the end surface interposed members 52. The molded resin portions 4 integrate the inner core portions 31 and the outer core portions 32 and integrate the coil 2, the magnetic core 3, and the insulating interposed members 5 that constitute the combined body 10. Also, as shown in FIGS. 2 and 3, resin also fills the intervals between the inner end surfaces 32*e* of the outer core portions 32 and the end surfaces of the inner core portions 31.

Reactor Manufacturing Method

Next, an example of a method for manufacturing the reactor 1 will be described. The method for manufacturing the reactor mainly includes a combined body assembly step and a resin molding step.

Combined Body Assembly Step

In the combined body assembly step, the combined body 10 including the coil 2, the magnetic core 3, and the insulating interposed members 5 is assembled (see FIGS. 4 to 9).

The set of the coil 2, the inner core portions 31, and the inner interposed members 51 is prepared by arranging the inner interposed members 51 between the inner core pieces 31*m* to produce the inner core portions 31 and inserting the inner core portions 31 into the two winding portions 2*c* of the coil 2 (see FIG. 8). Thereafter, the end surface interposed members 52 are arranged on both ends of the winding portions 2*c* and the outer core portions 32 are arranged so as to sandwich the inner core portions 31 from both ends (see FIGS. 6 and 7). Accordingly, a ring-shaped magnetic core 3 is constituted by the inner core portions 31 and the outer core portions 32. In the manner described above, the combined body 10 including the coil 2, the magnetic core 3, and the insulating interposed members 5 is assembled. In the state of the combined body 10, when viewed in the axial direction of the coil 2 (winding portions 2*c*) from the outer core portion 32 side, the resin filling holes 524 are formed in the end surface interposed members 52 (see FIG. 9).

Resin Molding Step

In the resin molding step, the outer core portions 32 are coated with resin, resin fills the spaces between the inner circumferential surfaces of the winding portions 2*c* and the inner core portions 31, and thus the outer resin portions 42 and the inner resin portions 41 are formed integrally (see FIGS. 1 to 3).

Resin molding is performed by arranging the combined body 10 in a mold and injecting resin into the mold from the outer core portion 32 sides of the combined body 10. An example is given in which the resin is injected from sides of the outer core portions 32 that are opposite to the sides on which the coil 2 and the inner core portions 31 are arranged. In this example, the outer core portions 32 and the end surface interposed members 52 are not fixed to the mold. Then, the outer core portions 32 are covered with resin and the resin fills the winding portions 2*c* via the resin filling holes 524 (see FIG. 9) of the end surface interposed members 52. Accordingly, the resin fills the intervals (see FIGS. 6 and 7) between the inner circumferential surfaces of the winding portions 2*c* and the outer circumferential surfaces of the inner core portions 31. At this time, resin also fills the spaces between the inner core pieces 31*m* and the intervals between the inner end surfaces 32*e* of the outer core portions 32 and the end surfaces of the inner core portions 31. Thereafter, the resin that was introduced is solidified, and thereby the outer resin portions 42 and the inner resin portions 41 are formed integrally (see FIGS. 2 and 3). Accordingly, the molded resin portion 4 is constituted by the inner resin portions 41 and the outer resin portions 42, the inner core portions 31 and the outer core portions 32 are integrated, and the coil 2, the magnetic core 3, and the insulating interposed members 5 are integrated.

The resin may fill the winding portions 2*c* from one outer core portion 32 side to the other outer core portion 32 side, and the resin may fill the winding portions 2*c* from both outer core portion 32 sides.

In the present embodiment, recessed portions 320 are formed in the outer core portions 32, and as shown in FIGS. 6 and 7, intervals c are formed between the end surface interposed members 52 and the outer core portions 32 by the recessed portions 320. For this reason, it is easier to introduce the resin into the resin filling holes 524 and it is easier for the resin to flow into the winding portions 2*c* through the resin filling holes 524, and therefore the resin can sufficiently fill the spaces between the inner circumferential surfaces of the winding portions 2*c* and the inner core portions 31.

Effects

The reactor 1 of Embodiment 1 exhibits the following effects.

Due to the recessed portions 320 being included on the circumferential edge portions of the inner end surfaces 32*e* of the outer core portions 32, the intervals c are formed between the end surface interposed members 52 and the outer core portions 32, and it is easier to introduce the resin into the resin filling holes 524 due to the recessed portions 320. For this reason, it is easy for the resin to flow from the resin filling holes 524 into the winding portions 2*c*, and it is easy for the resin to sufficiently fill the spaces between the inner circumferential surfaces of the winding portions 2*c* and the inner core portions 31. Accordingly, the ability of the resin to fill the winding portions 2*c* can be improved when the inner resin portions 41 are formed, and therefore the generation of a void in the inner resin portions 41 can be suppressed.

Furthermore, due to the recessed portions 320 being formed so as to be recessed inward with respect to the end surfaces of the inner core portions 31, the flow path areas of the resin filling holes 524 are larger at the locations of the recessed portions 320, and it is easier for the resin to flow into the winding portions 2*c* through the resin filling holes 524.

If the recessed portions 320 are provided on the corner portions of the inner end surfaces 32*e* of the outer core portions 32, the filling ability of the resin can be improved and a decrease in the effective magnetic circuit area can be suppressed. This is because in the magnetic core 3, the locations of the corner portions of the inner end surfaces 32*e* of the outer core portions 32 have a comparatively small influence on the effective magnetic circuit, since magnetic flux is comparatively unlikely to flow therein and functioning as an effective magnetic circuit is not likely to occur.

With the reactor of the present embodiment, it is effective to provide the recessed portions 320 not only in the case where the circumferential edges of the inner end surfaces 32*e* of the outer core portions 32 are located outward with respect to the inner circumferential edges of the through holes 520 of the end surface interposed members 52, but also in the case of using a reactor in which at least one side of the circumferential edge of the inner circumferential surface 32*e* is located inward with respect to the inner circumferential edge of the through hole 520 of the end surface interposed member 52.

The reactor 1 of Embodiment 1 can be suitably used in various converters, such as a vehicle-mounted converter (typically a DC-DC converter) mounted in a vehicle such as a hybrid automobile, a plug-in hybrid automobile, an electric automobile, or a fuel battery automobile, or a converter for an air conditioner, and in constituent components for electric power conversion apparatuses.

What is claimed is:

1. A reactor, comprising:

a coil including a winding portion;

a magnetic core including an inner core portion arranged inside of the winding portion and an outer core portion arranged outside of the winding portion;

an inner resin portion with which a space between an inner circumferential surface of the winding portion and the inner core portion is filled; and an end surface interposed member that is interposed between an end surface of the winding portion and the outer core portion and includes a through hole into which the inner core portion is inserted and a resin filling hole that communicates with an interior of the winding portion between the winding portion and the outer core portion, wherein the outer core portion includes a recessed portion on each one of a corner of the outer core portion so as to define a pair of protruding portions disposed between a pair of the recessed portions, the recessed portion being disposed on a circumferential edge portion of an inner end surface that opposes an end surface of the inner core portion, and wherein, each one of the recessed portion is formed so as to be recessed inward with respect to the end surface of the inner core portion.

2. The reactor according to claim 1, wherein the depth of the recessed portion is 2 mm or more.

3. The reactor according to claim 1, wherein the recessed portion has a rectangular outline shape, wherein a bottom surface of the recessed portion is generally planar and includes a first surface and a second surface, both of which are inclined so as to widen from the bottom surface to the inner end surface.

* * * * *